US007299781B2

(12) United States Patent
Nakada et al.

(10) Patent No.: US 7,299,781 B2
(45) Date of Patent: Nov. 27, 2007

(54) ENGINE OIL RETURN SYSTEM

(75) Inventors: Noaki Nakada, Yokohama (JP); Manabu Kato, Ota-ku (JP); Tomohiro Okamoto, Zama (JP); Thomas Hale, Northampton (GB)

(73) Assignees: Nissan Motor Co., Ltd., Yokohama (JP); Mahle Powertrain Ltd., Northampton (GB)

( * ) Notice: Subject to any disclaimer, the term of this patent is extended or adjusted under 35 U.S.C. 154(b) by 0 days.

(21) Appl. No.: 11/387,860

(22) Filed: Mar. 24, 2006

(65) Prior Publication Data

US 2006/0219206 A1 Oct. 5, 2006

(30) Foreign Application Priority Data

Apr. 4, 2005 (JP) ..... 2005-107776

(51) Int. Cl.
*F01M 9/00* (2006.01)

(52) U.S. Cl. ..... 123/196 R

(58) Field of Classification Search ..... 123/196 R, 123/90.33, 90.38; 184/6.5
See application file for complete search history.

(56) References Cited

U.S. PATENT DOCUMENTS 3,785,457 A * 1/1974 Strauber ..... 184/6.5
4,630,580 A * 12/1986 Sawaki et al. ..... 123/196 R

FOREIGN PATENT DOCUMENTS

JP 09-049414 2/1997

* cited by examiner

*Primary Examiner*—Tony M. Argenbright
*Assistant Examiner*—Hyder Ali
(74) *Attorney, Agent, or Firm*—Global IP Counselors, LLP

(57) ABSTRACT

An oil return passage for returning oil from a cylinder head to an oil pan is arranged along the downward first side surface of an engine that is mounted in a vehicle such that a center axis of a cylinder thereof is slanted with respect to a vertical direction of the vehicle. An oil return extension pipe is coupled to an outlet end of the oil return passage, and extends toward a second side surface of the engine that is opposite from the first side surface on which the oil return passage is provided. Thus, engine oil can be reliably returned to the oil pan from the cylinder head of the engine even when the vehicle is experiencing high acceleration in a direction that tends to cause backflow of the oil through the engine oil return system.

19 Claims, 2 Drawing Sheets

ENGINE OIL RETURN SYSTEM

CROSS-REFERENCE TO RELATED APPLICATIONS

This application claims priority under 35 U.S.C. § 119 to Japanese Patent Application No. 2005-107776. The entire disclosure of Japanese Patent Application No. 2005-107776 is hereby incorporated herein by reference.

BACKGROUND OF THE INVENTION

1. Field of the Invention

The present invention relates to an engine oil return system for returning oil from a cylinder head to an oil pan of an engine.

2. Background Information

Japanese Laid-Open Patent Publication No. 09-049414 describes a wet sump engine lubrication system configured to pump oil with an oil pump from an oil pan to engine parts requiring lubrication. After lubricating the engine parts, the oil returns to the oil pan from the cylinder head.

In view of the above, it will be apparent to those skilled in the art from this disclosure that there exists a need for an improved engine oil return system. This invention addresses this need in the art as well as other needs, which will become apparent to those skilled in the art from this disclosure.

SUMMARY OF THE INVENTION

In a conventional V-type engine, for example, an oil return passage for returning oil from a cylinder head to an oil pan is arranged in a slanted orientation along the downward side surface of each cylinder bank of the engine when the engine is installed in a vehicle. Thus, longitudinal or transverse acceleration of the vehicle will act on the engine to cause the oil inside the oil pan to lean toward the side of the oil pan where the oil return passages is located. If such longitudinal or transverse acceleration is large enough, the force of gravity will be not be sufficient to return the oil to the oil pan through the oil return passage. Furthermore, when the engine is installed such that the cylinder banks are slanted far from a vertical direction of the vehicle (i.e., the cylinder center axes are slanted far from the vertical direction of the vehicle), it is possible for the oil to flow backwards toward the cylinder head through the oil return passage and to cause the oil circulation to become stagnated.

The present invention was conceived in view of the above issue. Thus, one object of the present invention is to provide an engine oil return system wherewith engine oil can be reliably returned to the oil pan from the cylinder head even when the longitudinal or transverse acceleration of the vehicle is large.

In order to achieve the above object and other objects of the present invention, an engine oil return system is provided that comprises an engine main body and an oil return passage. The engine main body includes a cylinder head, a cylinder block and an oil pan. The engine main body has a first side surface and a second side surface that is opposite from the first side surface. The oil return passage includes a main oil return passage section and an oil return extension passage section with the main oil return passage section extending along the first side surface of the engine main body and the oil return extension passage section extending from the first side surface of the engine main body towards the second side surface of the engine main body of the engine such that an oil outlet opening is disposed at a location spaced from the first side surface towards the second side surface by a distance that substantially avoids oil in the oil pan from being forced up the main oil return passage section due to an acceleration on the engine main body occurring in a direction from the first side surface towards the second side surface.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
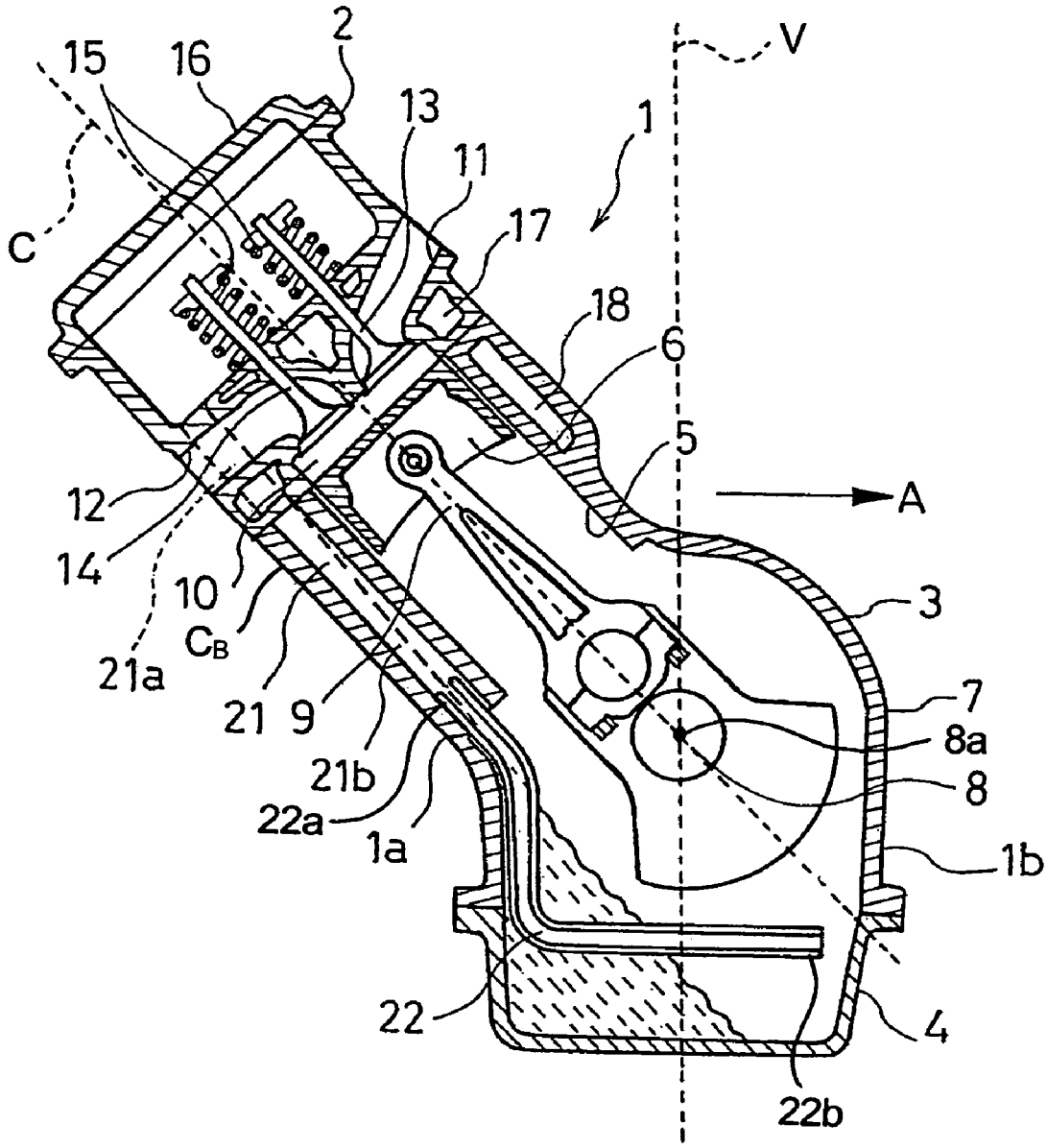
FIG. 1 is a cross sectional view of an engine provided with an engine oil return system in accordance with a preferred embodiment of the present invention illustrating a state of oil in an oil pan when a vehicle in which the engine is installed accelerates in a direction indicated with an arrow A.
Figure 2:
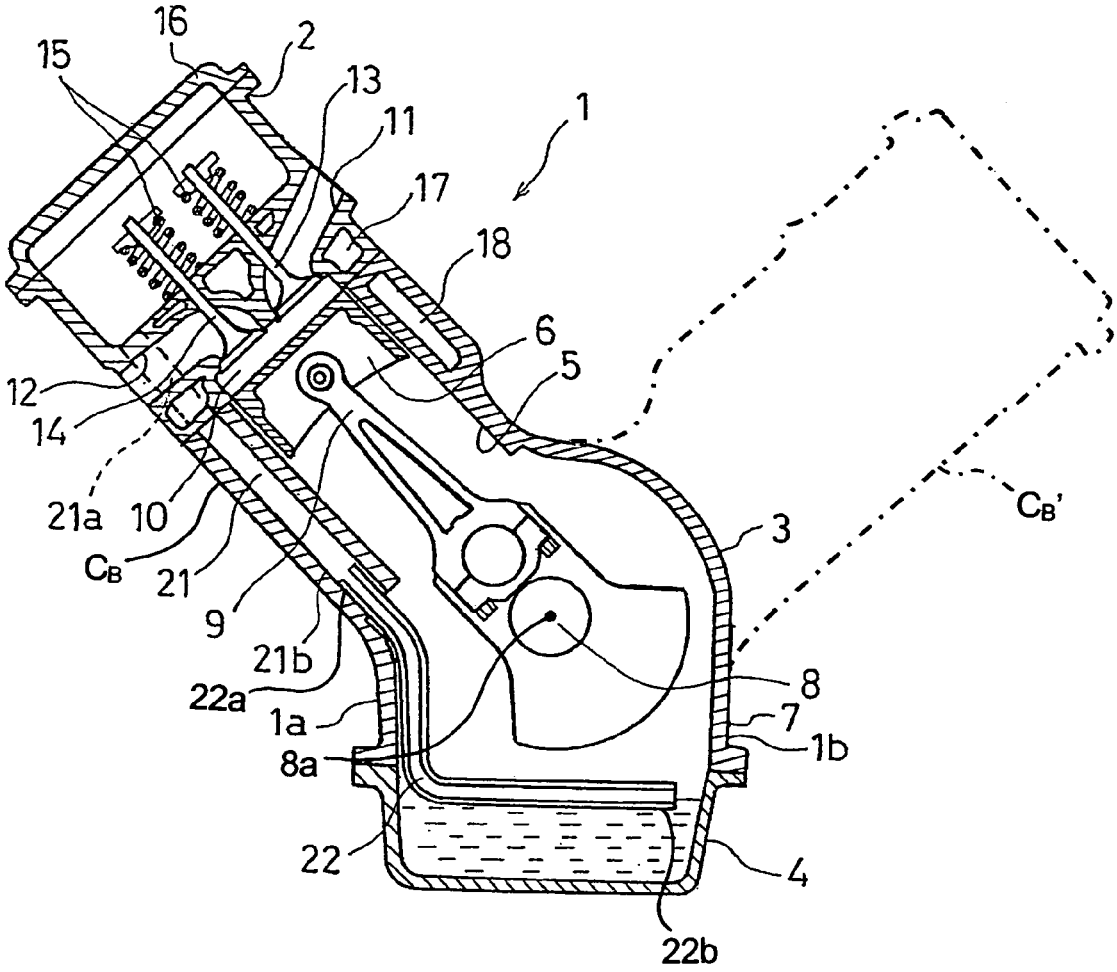
FIG. 2 is a cross sectional view of the engine illustrated in FIG. 1 in accordance with the preferred embodiment of the present invention illustrating a state of the oil in the oil pan when the vehicle is stationary and resting on a level surface.

FIGS. 1 and 2 illustrate a vehicle engine 1 that is provided with an engine oil return system in accordance with a preferred embodiment of the present invention. As seen in FIGS. 1 and 2, the engine 1 basically includes a cylinder head 2, a cylinder block 3, and an oil pan 4.

FIG. 1 shows a state of oil in the oil pan 4 when the vehicle in which the engine 1 is installed accelerates in a direction indicated with an arrow A. FIG. 2 shows a state of the oil in the oil pan 4 when the vehicle is stationary and resting on a level surface and the oil in the oil pan is substantially at an oil full level.

The acceleration of the vehicle in the direction of the arrow A can be either longitudinal (forward or reverse) acceleration or acceleration resulting from turning and/or depending on the orientation of the engine 1 in the vehicle. For example, if the engine 1 is installed in the vehicle such that the direction A corresponds to the forward direction of the vehicle, then FIG. 1 indicates the state of the oil in the oil pan 4 when the vehicle accelerates in the forward direction. Similarly, if the engine 1 is installed in the vehicle such that the direction A corresponds to the leftward transverse direction of the vehicle, then FIG. 1 indicates the state of the oil in the oil pan 4 when the vehicle is making a left turn.

As seen in FIGS. 1 and 2, preferably, an upper portion of the inside of the cylinder block 3 has a plurality of cylinder bores 5 (only one cylinder bore 5 is shown in FIGS. 1 and 2). A piston 6 (only one piston 6 is shown in FIGS. 1 and 2) is arranged in each one of the cylinder bores 5 such that each piston 6 moves reciprocally inside each cylinder bore 5 along an axial direction of the cylinder bore 5. More specifically, the piston 6 is configured and arranged to move reciprocally along a cylinder center axis C as shown in FIG. 1. The engine 1 is preferably installed in the vehicle such that the cylinder center axis C of the cylinder bores 5 is slanted with respect to a vertical direction V of the vehicle as shown in FIG. 1.

The engine 1 shown in FIGS. 1 and 2 is illustrated as an inline engine. However, it will be apparent to those skilled in the art from this disclosure that the engine 1 can be arranged as a V-type engine. In the case of a V-type engine, the engine 1 has an additional cylinder bank $C_B'$ that is symmetrical to a cylinder bank $C_B$ with respect to a vertical plane that includes a center axis 8*a* of a crankshaft 8 as shown in FIG. 2.

The direction in which the engine 1 is installed in the vehicle can be either longitudinal such that the center axis 8*a* of the crankshaft 8 is aligned with the longitudinal (lengthwise) direction of the vehicle or transverse such that the center axis 8*a* of the crankshaft 8 is aligned with the transverse (crosswise) direction of the vehicle.

The crankshaft 8 is rotatably supported in a crankcase 7 on a lower portion of the cylinder block 3. The reciprocal motion of the piston 6 is transmitted to the crankshaft 8 by a connecting rod 9 and thereby converted into rotational motion of the crankshaft 8. The oil pan 4 is mounted to an open bottom end of the cylinder block 3. A combustion chamber 10 is formed by the bottom surface of the cylinder head 2 and the cylinder bore 5.

The cylinder head 2 is provided with at least one intake port 11 for supplying intake air to the combustion chamber 10 and at least one exhaust port 12 for discharging combustion gas from the combustion chamber 10. The cylinder head 2 also has an intake valve 13 for opening and closing the intake port 11, an exhaust valve 14 for opening and closing the exhaust port 12, and valve springs 15 for spring-loading the intake and exhaust valves 13 and 14 toward the closed positions. The open and close actions of the intake valve 13 and the exhaust valve 14 are driven in synchronization with the engine rotation by a camshaft (not shown in FIGS. 1 and 2). A top portion of the cylinder head 2 is covered with a head cover 16.

The perimeter of the combustion chamber 10 is preferably cooled by coolant that circulates through a water jacket 17 in the cylinder head 2 and a water jacket 18 in the cylinder block 3.

The oil resting in the oil pan 4 is drawn out by an oil pump (not shown in FIGS. 1 and 2) that is driven by the engine 1 and circulated such that the oil returns to the oil pan 4 after lubricating the intake valve 13, the exhaust valve 14, and the camshaft in the cylinder head 2.

More specifically, as shown in FIG. 1, the engine 1 has at least one oil return passage that basically includes a main oil return passage 21 and an oil return extension pipe 22 for returning the oil from the cylinder head 2 to the oil pan 4 using gravity. The main oil return passage 21 preferably constitutes a main oil return passage section of the present invention, while the oil return extension pipe 22 preferably constitutes an oil return extension passage section of the present invention. In the illustrated embodiment, the main oil return passage 21 is formed of at least a pair of portions that are integrally formed with the cylinder head 2 and the cylinder block 3, while the oil return extension pipe 22 is a separate member that is attached to main oil return passage 21. Of course, it will be apparent to those skilled in the art from this disclosure that other configurations of the main oil return passage 21 and the oil return extension pipe 22 are possible for carrying out the present invention. In any event, the oil return passage (sections 21 and 22) is configured such that an oil outlet opening is disposed at a location spaced from a first side surface 1*a* (i.e., the left side in FIG. 1) towards a second side surface 1*b* (i.e., the right side in FIG. 1) by a distance that substantially avoids oil in the oil pan 4 from being forced up the main oil return passage 21 due to an acceleration on the engine main body occurring in a direction from the first side surface 1*a* towards the second side surface 1*b* as indicated by arrow A in FIG. 1. The outlet opening of the oil return passage (sections 21 and 22) is preferably disposed closer to the second side surface 1*b* of the engine main body than the first side surface 1*a* of the engine main body as seen in FIG. 1. More preferably, the outlet opening of the oil return passage (sections 21 and 22) is disposed adjacent to the second side surface of the engine main body.

In the illustrated embodiment, the main oil return passage 21 is provided on the first side surface 1*a* of the engine 1 that is positioned below the slanted center axis C of the cylinder (i.e., the left side in FIG. 1). As mentioned above, the main oil return passage 21 is preferably formed integrally with the cylinder head 2 and the cylinder block 3. The main oil return passage 21 comprises a first passage 21*a* that communicates between an upper surface (top deck) and a lower surface of the cylinder head 2 along the side surface 1*a* of the engine 1 and a second passage 21*b* that connects to the first passage 21*a* and that is formed between the cylinder bore 5 and the outside wall of the cylinder block 3 along the first side surface 1*a*.

The second passage 21*b* extends straight downward along the first side surface 1*a*, which is positioned below the slanted center axis C of the cylinder. An outlet end portion of the second passage 21*b* is provided just above the oil pan 4 as shown in FIGS. 1 and 2.

An inlet end 22*a* of an oil return extension pipe 22 is fitted into the outlet end portion at the bottom of the second passage 21*b*. The oil return extension pipe 22 is preferably made of metal. The oil return extension pipe 22 extends downward along the contour of the first side surface 1*a* and then turns to extend substantially toward the second side surface 1*b* of the engine 1 (i.e., right side in FIG. 1) that is opposite from the first side surface 1*a*. More specifically, the oil return extension pipe 22 preferably extends from the first side surface 1*a* toward the second side surface 1*b* in a substantially horizontal direction of the vehicle (i.e., left to right direction in FIG. 1). The oil return extension pipe 22 is arranged to open at an outlet end 22*b* disposed in a position adjacent to the second side surface 1*b* as seen in FIG. 1.

The height of the outlet end 22*b* (open outlet end) of the oil return extension pipe 22 with respect to a bottom surface of the oil pan 4 is preferably set to be substantially the same as the height of a top surface of the oil inside the oil pan 4 when the vehicle is stationary and resting on a level surface, as shown in FIG. 2. The oil return extension pipe 22 is preferably bolted to the cylinder block 3 in a plurality of locations using stays or flanges.

When acceleration, deceleration, or turning of the vehicle causes acceleration to occur in the direction of the arrow A shown in FIG. 1, the oil inside the oil pan 4 leans (collects) toward the first side surface 1*a* where the main oil return passage 21 is provided. Thus, the oil surface is lowered in the vicinity of the open end (the outlet end 22*b*) of the oil return extension pipe 22 as shown in FIG. 1. Also, as seen in FIG. 1, the oil inside the main oil return passage 21 leans (collects) toward the first side surface 1*a* when acceleration, deceleration, or turning of the vehicle causes acceleration to occur in the direction of the arrow A. The oil surface inside the second passage 21*b* of the main oil return passage 21 when the acceleration in the direction of the arrow A occurs is shown with a dotted line in FIG. 1.

Therefore, with the engine oil return system or device of the present invention having the main oil return passage 21 and the oil return extension pipe 22 as described above, the oil does not enter the outlet end 22*b* (open end) of the oil return extension pipe 22, and thus, the oil does not flow backwards when acceleration occurs in the direction of the arrow A shown in FIG. 1.

On the other hand, when acceleration occurs in an opposite direction of the arrow A shown in FIG. 1, the oil inside the oil pan 4 leans toward the second side surface 1*b* where the oil return extension pipe 22 opens at the outlet end 22*b*. In this case, however, the backflow of the oil does not occur even if the outlet end 22*b* of the oil return extension pipe is submersed in the oil because the oil is being pushed in the downstream direction of the oil return extension pipe 22.

Conversely, if the oil return extension pipe 22 is not provided and the oil return route consists of the main oil return passage 21 alone, then, when acceleration occurs in the direction of the arrow A shown in FIG. 1 and the oil inside the oil pan 4 leans toward the first side surface 1*a* where the main oil return passage 21 is provided, backflow of the oil will occur if the leaning oil surface reaches the open outlet end of the main oil return passage 21 because the acceleration will be acting in such a direction as to cause backflow through the main oil return passage 21. In short, when the oil return extension pipe 22 is not provided and the outlet of the main oil return passage 21 is arranged on the first side surface 1*a* that is positioned below the slanted cylinder center axis C, backflow of the oil will occur due to acceleration and such backflow will inhibit circulation of the oil and degrade the lubrication performance.

Accordingly, when the oil return extension pipe 22 is connected to the main oil return passage 21 that is arranged along the first side surface 1*a* positioned below the slanted cylinder center axis C and the oil return extension pipe 22 is configured to extend toward the opposite second side surface 1*b* as in the preferred embodiment of the present invention, then backflow of the oil caused by acceleration can be prevented. Thus, a high, stable lubrication performance can be maintained.

Additionally, in the embodiment explained above, the height of the outlet end 22*b* (open end) of the oil return extension pipe 22 with respect to the bottom surface of the oil pan 4 is set to be substantially the same as the height of the top surface of the oil inside the oil pan 4 when the vehicle is stationary and resting on a level surface as shown in FIG. 2. Consequently, the sounds associated with the return of the oil to the oil pan 4 can be suppressed. Moreover, the back flow of the oil can also be suppressed because the outlet end 22*b* of the main oil return passage 21 is positioned as high as possible.

Although in the embodiment explained above, the oil return extension pipe 22 is illustrated as extending from the first side surface 1*a* toward the second side surface 1*b* in a substantially linear fashion, it is not necessary for the oil return extension pipe 22 to be configured to extend toward the second side surface 1*b* in a linear fashion. For example, the shape of the oil return extension pipe 22 can be arranged to include curves in order to avoid an obstacle depending on the various design considerations of the engine 1.

Also, although it is preferable for the outlet end 22*b* the oil return extension pipe 22 to open at a position adjacent to the second side surface 1*b* as shown in FIGS. 1 and 2, the effect of the present invention can be realized in comparison with an oil return route consisting solely of the main oil return passage 21 so long as the outlet end 22*b* of the oil return extension pipe 22 opens at a position that is closer to the second side surface 1*b* than the outlet end of the main oil return passage 21.

In short, the height of the open outlet end 22*b* of the oil return extension pipe 22 with respect to the bottom surface of the oil pan 4 and the distance of the outlet end 22*b* from the second surface 1*b* can be set as appropriate in view of such factors as the shape of the oil pan 4, the slant angle of the cylinder center axis C with respect to the vertical direction V of the vehicle, and the like.

In a case of a V-type engine, since the backflow of the oil occurs more readily when the slant angle of the cylinder center axis C with respect to the vertical direction V of the vehicle is large, it is conceivable that one side of the V-type engine, for example, could have a stronger need for the oil return extension pipe 22 than the other side. For example, if the V-type engine is mounted in a vehicle in such a manner that the slant angles of the two cylinder banks $C_B$ and $C_B'$ with respect to the vertical direction of the vehicle are different, then it may be possible to avoid backflow of oil in both cylinder banks $C_B$ and $C_B'$ by providing the oil return extension pipe 22 only in one of the cylinder banks $C_B$ and $C_B'$ having the larger slant angle and not providing the oil return extension pipe 22 in the other one of the cylinder banks $C_B$ and $C_B'$ having the smaller slant angle.

On the other hand, if the oil return extension pipe 22 is provided in each of the cylinder banks $C_B$ and $C_B'$ of the V-type engine, the oil return extension pipes 22 are configured to extend in opposite directions. More specifically, in the case of a V-type engine, the oil return passages are formed in the cylinder banks $C_B$ and $C_B'$ on the opposite side surfaces (i.e., external side surfaces) of the engine that are positioned below the slanted center axes of the cylinder banks $C_B$ and $C_B'$. Thus, the oil return extension pipes extend in the inward direction from the external surfaces of the engine. Thus, backflow of the oil can be prevented when acceleration occurs in the direction of either one of the two external side surfaces of the engine.

It is also acceptable for the outlet end 22*b* of the oil return extension pipe 22 to be bent downward or otherwise oriented downward.

Furthermore, it is also acceptable to provide more than one oil return route comprising the main oil return passage 21 and the oil return extension pipe 22 at different locations along the direction in which the cylinders are arranged (i.e., along the axial direction of the crankshaft 8). For example, such oil return routes could be provided in two locations, such as on the both longitudinal end portions of the engine 1 with respect to the axial direction of the crankshaft 8.

Accordingly, in the engine oil return system in accordance with the present invention, the oil return extension pipe 22 connected to the main oil return passage 21 extends toward the second side surface 1*b* of the engine 1 where the oil is drawn out of the oil pan 4, which is the opposite of the first side surface 1*a* where the main oil return passage 21 is provided. Thus, when the vehicle accelerates such that the oil inside the oil pan 4 leans toward the first side surface 1*a* of the engine 1 where the main oil return passage 21 is provided, the oil return extension pipe 22 prevents a large amount of oil from flowing backwards due to the acceleration.

As a result, the return of oil to the oil pan 4 does not stagnate and the occurrence of insufficient lubrication can be prevented even when the vehicle undergoes sudden acceleration, deceleration, or turning.

As used herein to describe the above embodiment, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section extending along the first side surface of the engine main body and the oil return extension passage section extending from the first side surface of the engine main body towards the second side surface of the engine main body with an oil outlet opening of the oil return extension passage section being disposed at a location adjacent to the second side surface and above a top surface of oil in the oil pan that substantially avoids the oil in the oil pan from being forced up the main oil return passage section due to an acceleration on the engine main body occurring in a direction from the first side surface towards the second side surface.

2. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section extending along the first side surface of the engine main body and the oil return extension passage section extending from the first side surface of the engine main body towards the second side surface of the engine main body with an outlet opening of the oil return extension passage section being disposed at a location closer to the second side surface of the engine main body than to a midpoint between the first and second side surfaces of the engine main body and above a top surface of oil in the oil pan that substantially avoids the oil in the oil pan from being forced up the main oil return passage section due to an acceleration on the engine main body occurring in a direction from the first side surface towards the second side surface.

3. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section being integrally formed with the engine main body and extending along the first side surface of the engine main body and the oil return extension passage section extending from the first side surface of the engine main body towards the second side surface of the engine main body with an oil outlet opening of the oil return extension passage section being disposed at a location adjacent to the second side surface that substantially avoids oil in the oil pan from being forced up the main oil return passage section due to an acceleration on the engine main body occurring in a direction from the first side surface towards the second side surface.

4. The engine oil return system recited in claim 3, wherein the oil return extension passage section has an inlet end portion coupled to an outlet end of the main oil return passage section.

5. The engine oil return system recited in claim 3, wherein the oil return extension passage section includes an oil return extension pipe fixedly coupled to an outlet end of the main oil return passage section with the oil return extension pipe being formed as a separate member from the main oil return passage section.

6. The engine oil return system recited in claim 3, wherein the outlet opening of the oil return extension passage section faces the second side surface of the engine main body.

7. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section extending along the first side surface of the engine main body and the oil return extension passage section extending from the first side surface of the engine main body towards the second side surface of the engine main body with an oil outlet opening of the oil return extension passage section being disposed at a location adjacent to the second side surface that substantially avoids oil in the oil pan from being forced up the main oil return passage section due to an acceleration on the engine main body occurring in a direction from the first side surface towards the second side surface, at least part of the main oil return passage section and the engine main body being formed as a unitary one-piece member.

8. An engine oil return system comprising:

an engine main body including a cylinder head, a cylinder block and an oil pan, the engine main body having a first side surface and a second side surface that is opposite from the first side surface, the engine main body being configured and arranged to be installed in a vehicle such that the cylinder block includes a cylinder bore with a cylinder center axis that is slanted with respect to a vertical direction of the vehicle, and such that the first side surface is disposed downwardly with respect to the cylinder center axis; and an oil return passage including a main oil return passage section and an oil return extension passage section with the main oil return passage section extending along the first side surface of the engine main body and the oil return extension passage section extending from the first side surface of the engine main body towards the second side surface of the engine main body with an oil outlet opening of the oil return extension passage section being disposed at a location adjacent to the second side surface that substantially avoids oil in the oil pan from being forced up the main oil return passage section due to an acceleration on the engine main body occurring in a direction from the first side surface towards the second side surface.

9. The engine oil return system recited in claim 8, wherein the outlet opening of the an oil return extension passage section is disposed downwardly with respect to the cylinder center axis.

10. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section extending along the first side surface of the engine main body and the oil return extension passage section extending from the first side surface of the engine main body towards the second side surface of the engine main body with an oil outlet opening of the oil return extension passage section being disposed at a location adjacent to the second side surface that substantially avoids oil in the oil pan from being forced up the main oil return passage section due to an acceleration on the engine main body occurring in a direction from the first side surface towards the second side surface, the oil outlet opening of the oil return extension passage being disposed at a position that is substantially equal in height as a top surface of the oil in the oil pan with respect to a bottom surface of the oil pan when a vehicle in which the engine main body is installed is stationary and resting on a level surface and when the oil in the oil pan is substantially at an oil full level.

11. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section being integrally formed with the engine main body and extending along the first side surface of the engine main body and the oil return extension passage section extending from the first side surface of the engine main body towards the second side surface of the engine main body with an outlet opening of the oil return extension passage section being disposed at a location closer to the second side surface of the engine main body than to a midpoint between the first and second side surfaces of the engine main body that substantially avoids oil in the oil pan from being forced up the main oil return passage section due to an acceleration on the engine main body occurring in a direction from the first side surface towards the second side surface.

12. The engine oil return system recited in claim 11, wherein the oil return extension passage section includes an oil return extension pipe fixedly coupled to an outlet end of the main oil return passage section with the oil return extension pipe being formed as a separate member from the main oil return passage section.

13. The engine oil return system recited in claim 11, wherein the oil return extension passage section has an inlet end portion coupled to an outlet end of the main oil return passage section.

14. The engine oil return system recited in claim 11, wherein the outlet opening of the an oil return extension passage section faces the second side surface of the engine main body.

15. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section extending along the first side surface of the engine main body and the oil return extension passage section extending from the first side surface of the engine main body towards the second side surface of the engine main body with an outlet opening of the oil return extension passage section being disposed at a location closer to the second side surface of the engine main body than to a midpoint between the first and second side surfaces of the engine main body that substantially avoids oil in the oil pan from being forced up the main oil return passage section due to an acceleration on the engine main body occurring in a direction from the first side surface towards the second side surface, at least part of the main oil return passage section and the engine main body being formed as a unitary one-piece member.

16. An engine oil return system comprising:

an engine main body including a cylinder head, a cylinder block and an oil pan, the engine main body having a first side surface and a second side surface that is opposite from the first side surface, the engine main body being configured and arranged to be installed in a vehicle such that the cylinder block includes a cylinder bore with a cylinder center axis that is slanted with respect to a vertical direction of the vehicle, and such that the first side surface is disposed downwardly with respect to the cylinder center axis; and an oil return passage including a main oil return passage section and an oil return extension passage section with the main oil return passage section extending along the first side surface of the engine main body and the oil return extension passage section extending from the first side surface of the engine main body towards the second side surface of the engine main body with an outlet opening of the oil return extension passage section being disposed at a location closer to the second side surface of the engine main body than to a midpoint between the first and second side surfaces of the engine main body that substantially avoids oil in the oil pan from being forced up the main oil return passage section due to an acceleration on the engine main body occurring in a direction from the first side surface towards the second side surface.

17. The engine oil return system recited in claim 16, wherein the outlet opening of the an oil return extension passage section is disposed downwardly with respect to the cylinder center axis.

18. An engine oil return system comprising:

an engine main body including a cylinder head, a cylinder block and an oil pan, the engine main body having a first side surface and a second side surface that is opposite from the first side surface; and an oil return passage including a main oil return passage section and an oil return extension passage section with the main oil return passage section extending along the first side surface of the engine main body and the oil return extension passage section extending from the first side surface of the engine main body towards the second side surface of the engine main body with an outlet opening of the oil return extension passage section being disposed at a location closer to the second side surface of the engine main body than to a midpoint between the first and second side surfaces of the engine main body that substantially avoids oil in the oil pan from being forced up the main oil return passage section due to an acceleration on the engine main body occurring in a direction from the first side surface towards the second side surface, the oil outlet opening of the oil return extension passage being disposed at a position that is substantially equal in height as a top surface of the oil in the oil pan with respect to a bottom surface of the oil pan when a vehicle in which the engine main body is installed is stationary and resting on a level surface and when the oil in the oil pan is substantially at an oil full level.

19. An engine oil return system comprising:

main oil returning means for returning oil from a cylinder head to an oil pan of an engine along a first side surface of the engine; and oil return passage extending means for extending the main oil returning means from the first side surface toward a second side surface of the engine that is opposite from the first side surface with an oil outlet opening of the oil return passage extending means being disposed at a location adjacent to the second side surface and above a top surface of oil in the oil pan that substantially avoids the oil in the oil pan from being forced up the main oil returning means due to an acceleration on the engine occurring in a direction from the first side surface towards the second side surface.

* * * * *